US006325001B1

(12) United States Patent
Sheldon

(10) Patent No.: US 6,325,001 B1
(45) Date of Patent: Dec. 4, 2001

(54) PROCESS TO IMPROVE BOILER OPERATION BY SUPPLEMENTAL FIRING WITH THERMALLY BENEFICIATED LOW RANK COAL

(75) Inventor: Ray W. Sheldon, Huntley, MT (US)

(73) Assignee: Western Syncoal, LLC, Billings, MT (US)

( * ) Notice: Subject to any disclaimer, the term of this patent is extended or adjusted under 35 U.S.C. 154(b) by 0 days.

(21) Appl. No.: 09/692,937

(22) Filed: Oct. 20, 2000

(51) Int. Cl.[7] ..... F23B 7/00

(52) U.S. Cl. ..... 110/342; 110/263; 110/232; 110/224; 44/608; 44/620

(58) Field of Search ..... 110/342, 343, 110/344, 345, 263, 264, 232, 224; 44/608, 620

(56) References Cited

U.S. PATENT DOCUMENTS

| | | | | |
|---|---|---|---|---|
| 3,124,086 | * | 3/1964 | Sage et al. | 110/7 |
| 3,229,651 | * | 1/1966 | Wasp | 110/7 |
| 3,260,227 | * | 7/1966 | Daman et al. | 110/7 |
| 4,047,898 | * | 9/1977 | Cole et al. | 44/1 G |
| 4,059,060 | * | 11/1977 | Gambs et al. | 110/1 |
| 4,397,248 | * | 8/1983 | Mehta et al. | 110/263 |
| 4,412,839 | * | 11/1983 | Taylor | 44/1 B |
| 4,423,689 | * | 1/1984 | Merz et al. | 110/347 |
| 4,438,709 | * | 3/1984 | Borio et al. | 110/347 |
| 4,572,086 | * | 2/1986 | Ladt et al. | 110/347 |
| 4,725,337 | * | 2/1988 | Greene | 201/29 |
| 4,736,692 | * | 4/1988 | Eldh et al. | 110/224 |
| 4,750,913 | * | 6/1988 | Siddoway | 44/626 |
| 4,787,913 | * | 11/1988 | Goleczka et al. | 44/16 R |
| 4,810,258 | * | 3/1989 | Greene | 44/33 |
| 5,137,539 | * | 8/1992 | Bowling | 44/626 |
| 5,330,546 | * | 7/1994 | Ramesh et al. | 44/620 |
| 5,527,365 | * | 6/1996 | Coleman et al. | 44/626 |
| 5,546,875 | * | 8/1996 | Selle et al. | 110/342 |
| 6,152,054 | * | 11/2000 | Ashworth et al. | 110/345 |
| 6,199,494 | * | 3/2001 | Griffin | 110/348 |

* cited by examiner

*Primary Examiner*—Henry Bennett
*Assistant Examiner*—K. B. Rinehart
(74) *Attorney, Agent, or Firm*—Leonard Bloom

(57) ABSTRACT

The invention described is a process for improving the performance of a commercial coal or lignite fired boiler system by supplementing its normal coal supply with a controlled quantity of thermally beneficiated low rank coal, (TBLRC). This supplemental TBLRC can be delivered either to the solid fuel mill (pulverizer) or directly to the coal burner feed pipe. Specific benefits are supplied based on knowledge of equipment types that may be employed on a commercial scale to complete the process. The thermally beneficiated low rank coal can be delivered along with regular coal or intermittently with regular coal as the needs require.

11 Claims, 2 Drawing Sheets

POWER BOILER CONCEPT DIAGRAM

POWER BOILER CONCEPT DIAGRAM

SUPPLEMENTAL FUEL CONCEPT
- Addition Locations

PROCESS TO IMPROVE BOILER OPERATION BY SUPPLEMENTAL FIRING WITH THERMALLY BENEFICIATED LOW RANK COAL

This invention was made with Government support under Contract No. DE-FC 22-89PC89664 awarded by the Department of Energy. The Government has certain rights in this invention.

FIELD OF THE INVENTION

The herein disclosed invention is directed to improving combustion using coal for power steam boiler systems which use coal as the primary fuel.

The present invention is directed to the efficient combustion of coal and to reducing the detrimental effects of slag deposits and SOx and NOx emissions in the operation of coal fired boiler systems.

PRIOR ART PATENTS

Rickard, U.S. Pat. No. 4,263,856 provides pre-pulverized coal to the burner feed pipe for the purpose of supplementing the fuel feed quantity when the solid fuel pulverization mill is incapable of providing enough fuel to satisfy the demand requested. The present invention improves the quality of combustion and increases overall efficiency and not just simply increasing the available fuel supply to the boiler.

Westby, U.S. Pat. No. 5,364,421 blends coals with lignitic type ash and bituminous type ash compositions to modify the combined ash melting temperature for the purpose of reducing slag deposition on the heat transfer surfaces. The present invention blends TBLRC, typically containing altered lignitic type ash with other higher moisture coals containing either lignitic or bituminous type ash to improve the quality of combustion and reduce temperature imbalance issues as well as modifying the ash melting temperature. SynCoal specifically reduces the iron sulfide content providing a further beneficial effect.

Archer, U.S. Pat. No. 4,969,408 describes a control technique using an on-line analyzer to forecast coal combustion characteristics and adjusts the air flow to optimize combustion and minimize heat losses. This invention focuses upon the improving the stochiometric ratio through a feedback control system. It does not control the fuel characteristics and alter them in response to combustion monitoring. The subject invention is designed to alter the fuel combustion characteristics through the blending of TBI,RC with the standard solid fuel.

Shimoda, U.S. Pat. No. 4,465,000 describes a periodic injection of powdered limestone to add a high fusion temperature layer on the slag deposits making the slag deposits more friable and easier to remove using conventional soot blowing. Mahoney, U.S. Pat. No. 4,372,227 describes the addition of flue gas conditioner (such as alumina, silicon carbide, aluminum nitride) to nucleate molten particles and cause quicker solidification (crystallization) preventing deposition or making more friable deposits. Merrill, U.S. Pat. No. 4,577,227 describes the addition of amorphous silica particles >30 micron (~95 microns) to reduce the ash's tendency to stick or agglomerate due to increased fusion temperatures. Abrams, U.S. Pat. No. 4,616,574 describes intermittent injection of pressure hydrated dolomitic lime to reduce/modify slagging fouling deposits to lower the sintering strength and increase sintering temperature. Shimoda, Mahoney, Merrill and Abrams are all similar in that they add some non-combustible mineral to alter the coal ash characteristics to make it less likely to form slag or easier to remove with conventional slag removal techniques.

Brown, U.S. Pat. No. 4,319,885 is a method to capture $SO_2$ by mixing fibrous green crop material containing alkaline materials with coal. This acts like a combustion zone scrubber and will not improve the combustion characteristics. The subject invention improves the combustion characteristics and allows the boiler to function more efficiently as it was designed.

Forster, U.S. Pat. No. 4,396,434 is a method for breaking carbon rich slag deposits by injecting a chemical that embrittles the deposit and then applying acoustic air waves to break the deposit. Cavanagh, U.S. Pat. No. 2,151,264 is a method for breaking slag in open hearth furnaces using compressed $CO_2$ to fragment the slag and allow faster removal. Both Forster and Cavanagh are techniques to break the slag after it is formed and remove it from the boiler. The subject invention alters the fuel characteristics and improves the combustion characteristics to increase the operating performance of the boiler.

Definitions of Abbreviations as Ued Herein

- CPD—Colstrip Project Division, acronym used for the operations group at the Colstrip power plants
- ACCP—Advanced Coal Conversion Process, the name of the SynCoal process and the demonstration plant
- "Wye"—The rotary locks used to feed the SynCoal to the pneumatic transport line into Unit 2 have a "wye" venting arrangement to prevent the air leaking past the air lock from "bubbling" in the silo above and disrupting SynCoal flow to the rotary lock.
- PLC—programmable logic controller, the computerized control brain box
- I/O—input/output, refers to the communication between the sensors/PLC/controlled devices
- FM—Factory Mutual, the insurance agency's engineering group for review and recommendations
- NFPA—National Fire Protection Association, group that provides design guidance for fire protection systems
- SCFH—standard cubic feet per hour; it is a measurement of volumetric flow rate.
- SCFM—standard cubic feet per minute
- MW—mega watts
- LRC—low rank coal. The term "low rank coal" broadly encompasses a series of relatively low rank or low grade carbonaceous materials or coals including peat, the lignite coals (which encompass lignite and brown coal), the sub-bituminous coals (conventionally classified as rank A, B and C in the order of their heating values), and the bituminous coals.
- HRC—high rank coal
- MMI—man-machine interface

BACKGROUND OF THE INVENTION

Overview

The town of Colstrip, in southeastern Montana, is the site of four thermal generating plants, divided into Colstrip Units 1&2 and Colstrip Units 3&4. Colstrip Units 1&2 are twin 333 gross MW plants that have been in operation since the mid-1970's. Colstrip Units 3&4 are twin 805 gross MW plants that have been in operation since the mid-1980's. The entire generating plant complex is referred to as the "Colstrip project". In operation, a thermally beneficiated low rank coal (TBLRC) trade named SynCoal® is delivered by truck from the ACCP demonstration facility to the Colstrip project for use in Unit 2 on a daily basis. The SynCoal® is stored in a silo, and delivered pneumatically to three (3) of the Unit 2 coal mills at a continuous rate up to about 40 tph.

In conjunction with the U.S. Department of Energy under its Clean Coal Technology program, Western SynCoal LLC, a non-regulated indirect subsidiary of the Montana Power Company, is conducting a full-scale commercial demonstration of a patented technology which enhances Powder River Basin coal. The technology reduces moisture and sulfur and substantially increases BTU content (e.g., from 8,600 BTU/lb to 11,700 BTU/lb). These alterations to the raw coal result in a thermo beneficiated low rank coal trade marked as SynCoal®, a product which is drier, and cleaner-burning. The facility for producing SynCoal® is called the Advanced Coal Conversion Process plant (ACCP), and is located in Colstrip at the Western Energy Company (WECO) mine, and operated by WECo personnel.

SynCoal® is delivered by truck from the ACCP demonstration facility to the Colstrip project for use in Unit 2 on a daily basis. The SynCoal® product is stored in Units 1 and 2, and delivered pneumatically to three (3) of the Unit 2 coal mills at a continuous rate of up to about 40 tph.

Invention Demonstration Description

Using a single truck with tandem trailers hauling approximately 50 tons of SynCoal® per load, the delivered load from the ACCP is discharged onto the new unloading hopper which incorporates two (2) new 24" diameter screw conveyors and a new bucket elevator. The material is first fed from the trailer to the unloading screw conveyor positioned parallel to the truck, which in turn feeds the transfer screw conveyor perpendicular to the truck. The transfer screw conveyor in turn feeds a totally enclosed bucket elevator at a rate of 200 TPH. SynCoal® is transferred from the 135' high bucket elevator to the southern-most lime silo. The modified lime silo, fitted with a bin vent dust collector, holds approximately 600 tons of SynCoal® product.

Located within the existing modified silo building, the silo bottom is fitted with a three-way distribution manifold for mass flow of SynCoal® discharged into each of the three (3) rotary airlock feeders. One rotary airlock feeder corresponds with fuel supply to each of three (3) Unit 2 coal mills, through a 6" diameter pneumatic feed line. One rotary airlock feeder supplies fuel to the pneumatic pipe ending at mill #2A, another rotary airlock feeder supplies mill #2B, and the last rotary airlock feeder supplies #2D. A pneumatic operated knife-gate valve is located above each rotary airlock feeder for service of the equipment. Each 6" schedule 40 pneumatic feeder line is piped from the rotary airlock feeder to a 10" diameter expansion elbow located on the existing mill 12" diameter fuel down comer.

Each of three (3) pneumatic feeder pipes is supplied compressed air from each of three (3) positive displacement blowers sized to supply 1400 SCFM. The blowers are located in a new pre-engineered steel building, which in turn is located to the east of the silo building.

Each rotary airlock feeder is fitted with a venting wye and piped in such a manner as to facilitate the entrance of the product into the feeder pockets. The vented gas is piped to a new baghouse, which discharges vented gas to the atmosphere, and routes solids to the bucket elevator inlet chute.

The feed rate flow of SynCoal® flow to any single pulverizer will range between 2 and 20 TPH through each of the three (3) rotary airlock feeder feeders. The total capacity of the SynCoal® system with three (3) rotary airlock feeders running at their maximum speed is approximately 60 TPH, which is less than one third of the Unit 2 fuel requirements.

The rotary airlock feeders are proportionally controlled from the Unit 2 Control Room. Control of the feeders is effected through rotational speed rate (RPM) corresponding to a calculated mass flow rate. The control allows variation of the flow of SynCoal® by variable frequency drives. The new SynCoal® Feed Control System is configured to control SynCoal® feed while interfacing with appropriate signals from the existing Unit 2: 7300 Burner Control System and the Furnace Safeguard Supervisory System (FSSS). The SynCoal® Feed Control System is software programmable in order to provide an efficient means of changing the system operating characteristics. The SynCoal® Feed Control System consists of a PLC (GE) with I/O equipment, a workstation computer (MMI) and a monitor located in the Unit 2 Control Room Control Board.

The SynCoal® Feeders are initially started at minimum speed. Opening of the Silo Gate occurs after startup of the associated SynCoal® Feeder. Once started, the SynCoal® feed rate control may be placed in automatic. While in automatic, changes in the Feeder Master signal will divide the change between the SynCoal® feed rate and the raw coal feed rate equally on a BTU basis. The Silo Gate closes when either the SynCoal® feeder, or the raw coal feeder, or the associated mill or the entire Unit is tripped. During a normal shutdown, the Silo Gate will close and the associated SynCoal® feeder will shutdown after a time delay in order to purge the feeder and its upstream piping.

The pipe arrangement is such that any pulverizer can be removed from operation, while each of the other two pulverizers are fed from the SynCoal® pneumatic system. Each of the pipe bends are wear resistant to protect against abrasion. The piping and equipment from the silo to the pulverizer feed piping are designed to withstand a 50 psig dust explosion pressure per FM recommendations. In addition, each pneumatic line is fitted with a Deflagration Isolation System, designed per NFPA-69 to close the pneumatic line off in two directions to prevent propagation of an explosion event. Sensors mounted in the downstream pulverizer piping, and the upstream pneumatic transport piping send a signal to quickly close two deflagration isolation valves in the event an explosion event is detected.

A small membrane type nitrogen separator (approximately 1,700 SCFH) supplies 97%+pure nitrogen to the top of the silo continuously, thus preventing air infiltration into the SynCoal® product. A connection from the Unit 2 CARDOX system to the silo allows the potential to flood the silo with carbon dioxide in the event combustion is detected within the silo. Explosion (deflagration) vent panels are located on the silo and bucket elevator, based on NFPA-68 guidelines.

The SynCoal® Control includes continuous silo level and CO (carbon monoxide) concentration indication, in addition to trouble from either the Nitrogen system, or the Rotary Airlock Feeder vent baghouse.

STEAM BOILER POWER SYSTEM DESCRIPTION

In order to understand the invention it is necessary to briefly describe a typical coal combustion process in power boiler operations and the coal-related performance issues that these units may experience.

Figure 1:
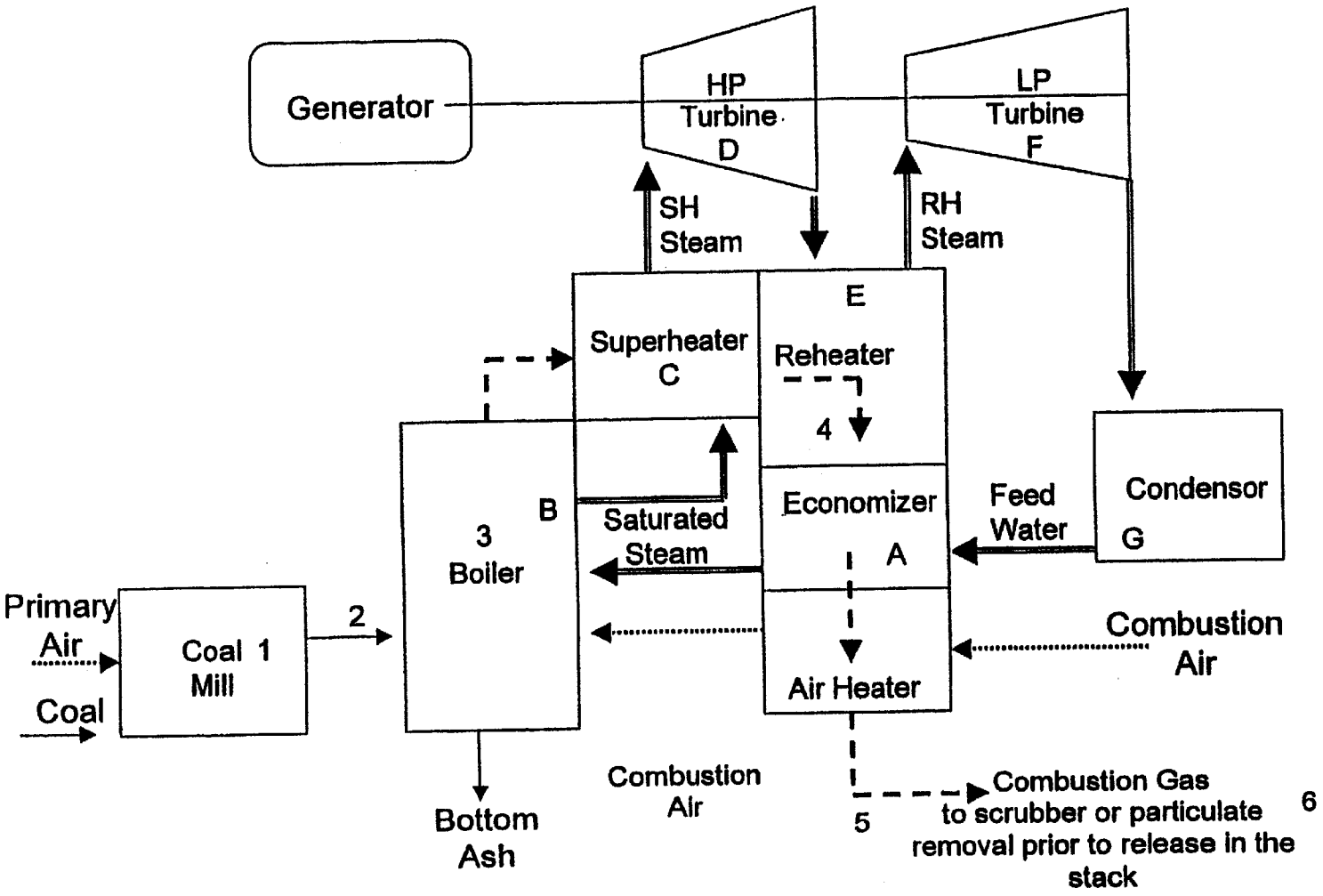
FIG. 1 is a schematic of the power boiler concept.
Figure 2:
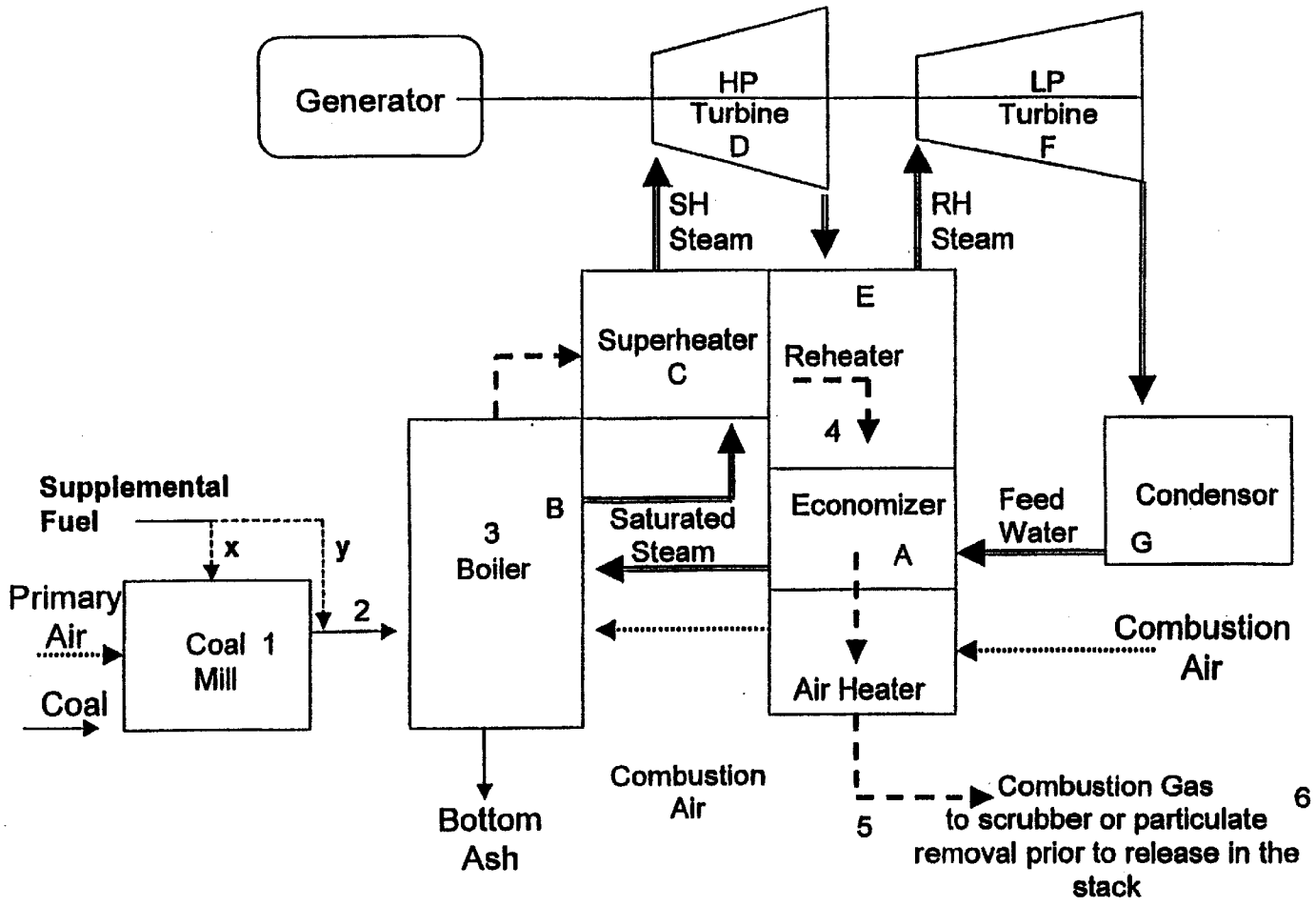
FIG. 2 is a schematic of the supplemental fuel concept.

The objective of the combustion process is simply to convert water to steam at the design flow, pressure and temperature to drive the turbines that generate the electricity. The water/steam path is schematically shown in the attached FIG. 1 is as follows:

A. Pressurized feed water is heated by the combustion gases in the economizer;

B. The hot feed water is boiled in the wall tubes of the combustion zone to produce saturated steam;

C. The saturated steam is heated in the superheat section;

D. The superheated steam is expanded in the high pressure turbine to rotate the generator shaft;

E. The steam exhausted from the high pressure turbine is heated in the reheat section;

F. The reheated steam is further expanded in the low pressure turbine to add energy to the generator shaft;

G. The exhaust steam is cooled to convert it back to water in the condenser;

A. The water is re-pressurized and re-fed to the economizer.

Coal Fired Steam Boiler Power System Description

The coal combustion process involves the following steps:

1. The coal particle size is reduced and some moisture is liberated by hot primary air;
2. Coal and heated combustion air are injected into the combustion zone of the boiler;
3. Coal is ignited, the volatile matter is burned and then the char is burned in the combustion zone (radiant section) of the boiler producing gaseous combustion products;
4. Combustion products exit the combustion zone and pass through the convective sections (superheat, reheat, economizer) of the boiler;
5. Fly ash and gaseous pollutants (if scrubbed i.e. SOx, NOx) are removed from the combustion gases;
6. Gases and other waste products exit the system.

Typical power plants transfer heat produced from the combustion of the coal to the steam in three stages. The first stage (boiler) converts the high pressure feed water into saturated steam. The second stage (superheater) adds additional heat to the steam prior to its expansion in the high pressure turbine. The third stage (reheater) adds additional heat to the exhaust steam from the high pressure turbine prior to its continued expansion in the low pressure turbine. The turbines are typically connected by a common shaft, which turns an electric generator to produce electricity. The system is designed to balance the flow rates of the feed water, superheated high pressure steam and reheated expanded steam while heating each stream to its optimum temperature. When the combustion process is not operated at the design optimum, an imbalance is created between the heat released from combustion and the heat absorbed by one or more of the three heat transfer stages. This imbalance requires the operations to be adjusted by altering the steam flow rates between the heat transfer stages, by adjusting the coal firing location or rate, or by altering the combustion air flow rate, or recycling or diverting flue gas flows. Any deviation from optimum conditions will reduce the overall thermal efficiency and/or the overall power output.

The performance of a power boiler is typically measured by its operating efficiency and its availability. Boiler efficiency is expressed as the amount of chemical energy in the fuel consumed to produce a given quantity of steam. Therefore, efficiency is directly related to the amount of unburned fuel, the heat lost to boiler slagging and fouling and the heat lost with the exhaust gases (especially water vapor). Boiler availability is a function of the number of tube failures caused by corrosion, erosion, slagging or fouling; derating of the unit due to component failures (such as a pulverizer) or a temperature imbalance; and wear and tear on the combustion gas passages from the impingement of ash particles and abrasion.

The ash gives coal combustion its unique character. Without ash, all furnaces could easily be designed on the basis of heat transfer only. The most troublesomc coal-related issues affecting the operation of a boiler are:

Temperature imbalance—too much or too little heat transferred from the radiant section to the feed water or from the convective section to the saturated steam or expanded steam;

Slagging—deposits of mineral matter that fuse and form on furnace walls and other surfaces in the combustion zone of the boiler;

Fouling—high temperature, bonded deposits that form on the superheater and reheater tubes in the convective section of the boiler;

Corrosion and abrasion—the damage to the boiler tube surfaces caused by chemical reaction between the ash particles and the boiler parts and the physical wear on these surfaces of the high velocity ash particles impinging on them;

These coal ash related issues are interrelated and difficult to explain separately. During combustion, temperatures can reach 3,200° F., but the gases must cool to about 2,000° F. before entering the convective sections (back pass) of the boiler. The temperature of the gas entering the convective section is called the furnace exit gas temperature (FEGT) and it directly relates to the overall operating efficiency and back pass problems.

If the coal burns too quickly too much heat can be absorbed in the radiant section of the boiler, reducing the FEGT so much that when the combustion gases reach the superheater tubes that they can not raise the steam temperatures to the levels necessary for efficient turbine operation and full-capacity utilization. If the temperatures in the radiant section rise too high the boiler wall water circulation can be aversely impacted or an increase in boiler slagging can result.

If the coal burns too slowly, insufficient heat can be transferred through the boiler walls causing the FEGT to be too high and ash particles are too hot (and still sticky) when they enter the convective section and foul the tubes. Additionally, there can be a decrease in boiler performance through decreased steam production, fouling of convective surfaces, increased qualities of unburned fuel, or loss of superheater temperature control. Clean waterwalls in the combustion zone or radiant section will allow greater heat transfer in these areas and decrease the FEGT. This will also reduce $NO_x$ generation by removing the heat faster thus reducing the average combustion zone temperature and reducing the creation of thermal NOx.

The temperature imbalance between heat transfer stages can also be caused by changes in the combustion gas mass flow rate or slag deposition on the heat transfer surfaces impeding the transfer of heat from the combustion gases to the steam. This reduces the quantity of steam available from that stage at the desired conditions and increases the amount of heat to be removed in later heat transfer stages or lost "up the stack".

In most power boilers combustion takes two seconds or less. During this short period of time, complex chemical reactions occur between the various minerals components of coal, collectively referred to as ash content. They form new and more complex compounds, usually containing less oxygen than the original constituents, due to the severely reducing environment of reducing gases and hot carbon. These reactions are extremely important because they affect the formation of chemical compounds that promote slagging, fouling and corrosion.

Iron compounds are responsible for much of the misbehavior of coal ash. In the case of pyrite, while passing through the furnace, both the iron and the sulfur may combine with oxygen, iron mass forming lower oxides, the sulfur mass forming or combining with the alkaline metals, sodium and potassium to form sulfur compounds, all with very low fusion temperatures. In cyclone fired or wet bottom pulverized coal furnaces metallic iron may sink to the bottom of the molten slag and is difficult to remove in either hot or cold state. As a rule, ash high in silicon dioxide or alumina has a high softening temperature, and this temperature is not greatly affected by reducing atmosphere.

As coal or lignite is combusted in a typical boiler, the contained mineral matter (ash) is melted. This material is "sticky" in its molten state and can build up on the walls inside the boiler as "slag". As this slag builds up on the boiler walls, it insulates the boiler walls impeding heat transfer to the water or steam. This reduces the boiler's efficiency and forces the heat from combustion to move further along the combustion gas path overheating the convection section of the boiler and allowing the mineral matter to remain "sticky" further promoting even more deposition. This temperature imbalance causes an upset in the designed steam cycle forcing the boiler to operate in a manner different (and less efficiently) than designed. Many coal or lignite fired boilers suffer from the formation of slag on the boiler walls reducing the overall heat transfer, efficiency and steam production by impeding the transfer of heat to water to generate steam. As slag deposits increase, the ability to generate steam is reduced and partial de-rating of the boiler can occur resulting in inefficient operations and reduced economic performance. Ultimately, accumulated slag deposits can fall to the bottom of the boiler. The standard methods for removing the slag deposits involve either the use of soot-blowers, water lances or for more persistent deposits reducing firing rate to cool the entire boiler. Soot-blowers typically use steam diverted from the steam power cycle (the boiler's primary purpose) to physically dislodge the slag from the walls. This "robbing" of steam from the steam power cycle reduces the overall efficiency of operation. Water lances thermally shock the slag deposits by direct water contact, causing the deposits to fracture and shrink pulling themselves from the boiler walls. This directly cools the boiler and increases the amount of heat lost as water vapor in the exhaust gas reducing the overall efficiency. Finally, cooling the boiler by reducing load severely limits the boiler's steam production, reducing overall output and forces the owner to purchase make up power, auxiliary systems to provide the incremental steam or otherwise suffer the economic loss related to the production limitation.

Additionally, all of these slag removal methods cause some damage to the boiler walls. As the slag deposit is removed it typically pulls some metal away from the boiler walls. The soot-blowers can erode the boiler walls by forcing slag particles to "sand blast" the boiler walls as the slag deposit is blasted away. Water lances cause localized cooling of the boiler walls placing high levels of thermal stress in the walls causing metal fatigue and wear as the walls contract and then expand. Load reductions to "shed the slag" put similar thermal stresses on and fatigue the boiler walls. Usually this approach is taken when there is a severe slag problem and large slag buildups or clinkers (often 2–3 tons in weight) can be caused to fall inside the boiler damaging the lower sections of the boiler. Such damage is likely to cause forced outages and reduce unit availability.

Even the actions taken to remove the slag deposits from the boiler walls before they become this large causes physical damage to the boiler walls themselves, increasing the need for future maintenance and repairs, and further damaging the overall economic performance of the boiler. Slag deposition also causes temperature imbalances in the boiler since combusted gases in the radiant section do not cool. Instead, excessively hot gases enter the convective section and cause superheater temperatures to run out of control, increasing the likelihood of fouling, endangering the unit and possibly causing tube failures.

Convective section fouling impedes, and can block, exhaust gases passing through the convective section. Fouling also impedes transfer of heat through the superheater tube walls, thus partially derating the boiler. Additionally, the gas flow restriction caused by fouling increases the pressure required to move the combustion gases through the convective section thus increasing the auxiliary power requirements of the unit.

Damage to superheater tubes can occur when mineral matter from coal ash is deposited on the tubes (fouling) and is corrosive. Fouling and corrosion result mainly from selective condensation of alkali metal salts on superheater tubes. These salts are formed through the interaction of sodium and potassium metals with chlorine, sulfur and other ash components. These salts are extremely corrosive and the principal cause of damage to superheater tubes. In this way, corrosion and fouling are linked.

Finally, coal quality characteristics directly affect boiler design and in turn the capital costs of a generating facility. Coals with different characteristics can be compensated for, but only at high cost. For example, boilers designed to operate with coals possessing slagging and fouling tendencies are larger than units operating with coals with minimal tendencies to slag or foul. Thus the expected slagging and fouling tendencies of the coals used are a major cost consideration for the design and construction of any unit. Likewise, coal quality considerations affect the cost of peripheral equipment associated with the unit. For example, particularly hard coals or those with particularly abrasive mineral content require more expensive and higher capacity pulverizer installation than less demanding coals. To the extent that coal characteristics reduce the availability of the unit, they increase the direct maintenance costs and decrease the utilization efficiency magnifying the fixed costs on a unit of production basis.

As a coal or lignite fired boiler gets older, the original coal or lignite reserve is depleted. The coal or lignite used to replace the original fuel is usually poorer in quality than the original design fuel: lower in heating value and higher in ash. Inferior quality fuels reduce the operational flexibility making the boiler more susceptible to slag deposition and heat balance upsets.

Recently, western sub-bituminous coals (low rank coals) have been widely used in boilers designed to use bituminous coals. Most of these boilers are physically undersized and have a much narrower tube spacing than desired to accommodate the increased fuel and gas volumes and more alkaline ash that results from the use of western sub-bituminous coals. In addition, these boiler systems often have limited pulverizer capacity required to accommodate the increased moisture content and fuel volume experienced with western sub-bituminous coals.

Explanation of the Invention

Providing an independent supply of TBI,RC which has significantly different characteristics from both raw low rank( coals and higher ranked coals can allow for greater flexibility in adjusting the boiler firing characteristics to balance the desired combustion heat release and heat transfer in each steam stage. A qualitative comparison of the typical characteristics is shown below:

| TBLRC (i.e. SynCoal) | Low Rank Coals | High Rank Coals |
|---|---|---|
| Lower moisture | High Moisture | Moderate to low moisture |
| Lignitic ash-Fe/Ca + Mg < 1 | Lignitic ash | Bituminous ash-Fe/Ca + Mg > 1 |
| Lower NOx | Lower NOx | Higher NOx |
| Faster ignition | Slow ignition | Fast ignition |
| High volatile | High volatile | Moderate volatile |
| Lower sulfur | Low sulfur | Higher sulfur |
| High heating value | Low heating value | High heating value |

SynCoal® has had most of the iron pyrites and some of the shales removed by the physical cleaning process. This has a dramatic impact on the formation of slag as the iron and sulfur contents are reduced and the calcium to iron ratio is significantly increased. This coupled with the increased silica percentage (of the ash) increases the ash fusion temperatures and makes the ash less "sticky".

The TBLRC ignites easier and burns with a more steady flame than raw low rank coal or higher rank coals. The rapid ignition and steady flame characteristics allow more of the combustion to occur in the region of the furnace that was designed for this purpose which reduces slag formation on the heat transfer surfaces. Low rank coals inherently burn with lower nitrogen oxide emissions than higher ranked coals and the TBLRC enhance this property while providing the higher boiler efficiency (percentage of heat transferred to the working steam from the combustion process) of the higher ranked coals. An ancillary benefit is the reduction of thermal NOx production. The cleaner boiler can remove the heat of combustion quicker reducing the average combustion zone temperature and limiting the formation of thermal NOx.

Typically, the combustion zone is characterized by fluctuating combustion pressure, temperature and stoichometry: ranging from below optimum to above and back. Even if the average values are optimized a substantial portion of the operating time is spent at non-optimum conditions. Since coal ash tends to form slag easier in a reducing (oxygen depleted) environment, these fluctuations from optional stochiometry makes the boiler operation difficult as localized strongly oxidizing zones will produce thermal and localized strongly reducing zones will promote slag deposition. The steady flame produced by supplementing the fuel supply with the addition of TBLRC reduces these fluctuations, which increases the amount of time the boiler operation is in a more optimum condition.

The result is a better operation with reduced slag formation, reduced emissions, higher thermal efficiency, reduced maintenance cycles, increased productive output and more cost efficient performance.

The low moisture content of the FBLRC allows the pulverization mill to maintain a higher temperature (closer to design expectations) helping to further dry the raw coal during the pulverization process.

The higher energy density of the TBLRC allows the pulverizer to operate at a lower coal loading increasing its efficiency. This provides more flexibility to the operator either allowing the classifiers to be set to produce a smaller average particle size or reduce the work performed by the pulverizer to produce the same average particle size. Additionally, the TBLRC tends to be smaller in feed size and more friable (easier to pulverize) as long as enough raw coal is mixed with it to prevent the pulverizer rollers from "plowing" instead of rolling over the coal layer in the mill. The TBLRC can be "slippery" due to the uniform size and low cohesive properties which allows it to "plow" in front of the pulverizer rollers instead of forming a coal bed on which the pulverizer rolls run, compacting and crushing the coal particles.

SUMMARY OF THE INVENTION

Conceptually the TBLRC can be used in several separate applications. TBLRC can be used combined with other types of coal to produce beneficial combustion results; TBLRC can be used alone, intermittently in a coal supply stream; or if slag build-up is noted, a "hot shot" of TBLRC can be supplied to mitigate the slag build-up problem.

If TBLRC is to be used intermittently, it would be used alone about 3 or 4 hours a day during periods of peak power demand.

When TBLRC is to be used as a "hot shot", it is to be used for about 30 minutes when slag build up is noticed.

Thermally beneficiated low rank coal (TBLRC) can be used as a supplemental fuel to improve coal combustion and reduce boiler slag deposits. Supplemental firing with TBLRC such as SynCoal® has the effect of improving the average coal quality characteristics. Additionally, because of the rapid ignition and highly radiant flame characteristics heat transfer to the boiler walls is improved. Due to the low moisture content mill performance is enhanced over the high moisture primary feed coal and the overall gas flow through the boiler is reduced, decreasing fan requirements and increasing heat transfer to the steam. Benefits include:

Increase combustion zone temperature;

Decrease ignition time (coal burns in the proper zone as designed);

A steadier flame (gas flow is less turbulent allowing ash particles fall out where the designer intended); and Improved heat rate.

These combustion benefits translate to:

Increased mill capacity;

Reduced slag formation;

Reduced fan and mill requirements;

Reduced auxiliary electrical demand; and

Reduced thermal NOx formation.

Slag deposits limit the heat transfer between the combustion gas and the steam/water in the boiler. They also restrict the gas flow thus increasing the fan power requirements. The supplemental fuel quantity can be controlled by a volumetric or gravimetric feed system to deliver the TBLRC to the solid fuel mill or to the coal burner feed pipe.

Other fuels used to supplement low rank coal in combustion applications include:

Natural gas;

Fuel oil;

Naturally occurring bituminous coals.

For purposes of this invention an example of thermally beneficiated low rank coal (TBLRC) is SynCoal®, a patented low moisture, high volatile coal product (U.S. Pat. No. 4,810,258) produced by substantial removal of moisture and impurities from low rank coal by a patented low pressure process (U.S. Pat. No. 4,725,337) which heats the low rank coal to greater than 300° F. by direct contact with a recycled superheated gaseous medium thereby substantially desorbing the moisture, fracture releasing a portion of the ash impurities and decarboxylating the low rank coal. A substantial portion of the superheated gaseous medium (containing water vapor, organic volatiles and carbon dioxide) from the contacting chamber is reheated and recycled to the contacting chamber. The ash impurities fracture released from the coal are easily removed by a physical separation technique.

SynCoal® is less expensive than fuel oil or natural gas and can be delivered to exactly the same combustion zone in the same fashion as the regular solid fuel. Additionally, natural gas has a translucent flame so that it transfers less radiant heat to the boiler walls. Compared with bituminous coals, TBLRC is typically more reactive, has a lower moisture content and has more alkaline ash characteristics. TBLRC also typically produces less SOx and NOx emissions than most bituminous coals. SynCoal® is also very low in iron pyrites, due to the physical cleaning included in the process. This enhances its performance in this application by increasing the ash fusion temperatures and reducing the tendency for the ash to form slag and foul the heat transfer surfaces in the steam boiler system.

Applications

Supplemental TBLRC can be delivered either to the solid fuel mill (pulverizer) or directly to the coal burner feed pipe. The supplemental fuel quantity can be controlled by a volumetric or gravimetric feed system to deliver the TBLRC to the solid fuel mill or to the coal burner feed pipe.

Generically, a controlled flow rate of supplemental TBLRC is delivered by a conveying means to either (i) the size reducing mechanism (crusher or pulverization mill) which prepares the coal for feed to the coal fired boiler; or (ii) directly to the coal fuel transport pipe which leads to the coal burner nozzle, if the TBLRC particle sizes are already fine enough. The flow rate can be controlled volumetrically by a variable speed rotary feeder (or similar device) or gravimetrically by a weight belt feeder, loss-in-weight feeder or similar device. The conveying means can be gravity feed through a chute (which may require a pressure isolating device such as a rotary airlock, lock-hopper or similar device) or pneumatic feed through a pipe connected to the fed chute into the size reducing mechanism or the coal fuel transport pipe directly.

The quantity of supplemental fuel supplied is adjusted based upon the operating parameters. The best results occur when between 5 and 20 percent of the total fuel energy input is provided by the TBLRC, although it may be advantageous at times to supply as little as 1 percent or as much as 100 percent. The specific fuel mix can be easily controlled by any multi-fiel firing control system or by using a programmable logic controller to split the fuel demand signal form a single fuel firing control system to signal the feeders and control the combined fuel mix.

General benefits of steady use realized by the use of this invention are:

1.) Improving quality of combustion.
2.) Mill performance is increased.
3.) Reduction of gas flow and decreased fuel requirements.
4.) Improved boiler efficiency.
5.) Nitrogen oxides (NOx) and sulfur oxides (SOx) emissions are reduced.
6.) Slag deposits are reduced (with hot short or steady use).
7.) More rapid ignition along with highly radiant flame characteristics.

In specific applications of this invention the effective amounts of thermally beneficiated low rank coal (TFBLRC) relative to raw ordinary coal will be about 8%; the preferred range is approximately 5 to 10%; and the inventor contemplates an overall range of about 2% to 20% as being operative. Specific applications contemplate use outside of these ranges and these ranges can be determined by those skilled in the art.

The coal used with TBLRC of this invention is any low rank coal or poorly performing bituminous coal. Low rank coals are high volatile biuminous coal, sub-bituminous coal, lignite and peat. Specific examples of low rank coals useful for this invention are Powder River Basin sub-bituminous coal, Great Plains lignite and Gulf-Coast lignite. Rosebud coal (low rank coal) is raw sub-bituminous class C coal.

Also, contemplated by this invention is the feeding of TBLRC intermittently with low rank coal. This intermittent use will take the form of intermittently adding a shot of TBLRC to a boiler already being fired with a low rank coal; or simply periodically stopping (burning) with low rank coal and completely substituting burning with TBLRC. This intermittent use of TBLRC will be especially useful during peak hours of electric consumption. For example, a load or loads of TBLRC to the burn-schedule.

In its broadest aspect, this invention envisions a combustible coal mixture comprising an effective amount of thermally beneficiated low rank coal added to ordinary coal, oil or gas; wherein, the mixture provides improved combustion characteristics.

Also, contemplated is a method for improving the combustion properties of coal comprising feeding regular quantities of coal to the combustion chamber and intermittently supplying thermally beneficiated low rank coal to the combustion chamber and thereby reducing boiler slag.

In an alternative embodiment, this invention involves a method of operating a coal-fired furnace, wherein the coal and ash melt and form a slag which coats the interior of the furnace. builds up and forms clinkers, and reduces the operating thermal efficiency of the furnace, and wherein relatively-expensive fuel oil or natural gas may be injected into the furnace as a "kicker" or "hot shot" to control the ash, reduce the slag, and improve thermal efficiency, the improvement which comprises the step of inputting a beneficiated low-rank coal which has been processed to remove impurities and moisture content, thereby obviating the use of relatively-expensive fuel oil or natural gas, and thereby controlling the ash and the formation of slag, improving safety conditions, and improving the thermal efficiency while realizing cost savings. Moreover, the beneficiated low-rank coal can be mixed with the coal being supplied to the furnace.

As an alternative embodiment of this invention applicant instead of feeding thermally beneficiated low rank coal (TBLRC) and regular coal combined in a single feed, applicant contemplates a feed whereby regular coal is fed to the combustion zone of the boiler and intermittently TBLRC alone is fed to the combustion zone. This constitutes a hot-shot and is designed to decrease the amount of slag produced in the combustion compartment of the boiler and increase the available firing (heat release) in the boiler to achieve higher unit power for a relatively short period of time.

Preferred Embodiment

For pulverized coal (PC) fired boilers, when applied to pulverized coal fired boilers, it is preferable to convey the controlled quantity of TBLRC to the coal inlet port of the coal pulverizing mill using either a gravity feed or pneumatic conveying means depending upon the plant configuration. TBLRC is fed in a controlled manner to the feed port of the coal pulverizer, blended with the raw coal in the pulverization process, and subsequently fed into the boiler through the standard coal nozzles. The control system can control the total thermal input to the boiler by holding either the raw coal or TBLRC feed rate constant and respectively varying the other, or by varying both the raw coal and TBLRC feed rates to maintain the same proportion of heat input from each fuel. Operational efficiency and slagging characteristics determine the optimum blend and controlling the location of supplemental fuel addition in relation to the combustion air can further reduce thermal NOx formation and quantity and enhance steam output. Due to the low moisture content, mill performance is enhanced over the high moisture primary feed coal and the overall gas flow through the boiler is reduced decreasing fan requirements and increasing heat transfer to the steam.

The particle sizing of TBLRCs is normally small enough that when applied to a cyclone-fired boiler, it is preferable to feed the TBLRC using a gravity feed conveying means directly into the coal fuel transport pipe which leads to the coal nozzle in the cyclone barrel. For cyclone combustion boilers, the TBLRC is fed at a controlled rate directly into the coal transport pipe blending with the raw coal as it is transported to the coal nozzle in the cyclonic burner barrel. As with the pulverized coal fired boilers, the control system can control the total thermal input to the boiler by holding either the raw coal or TBLRC feed rate constant and varying the other or by varying both the raw coal and TBLRC feed rates to maintain the same proportion of heat input from each fuel. Operational efficiency and slagging characteristics determine the optimum blend and controlling the location of supplemental fuel addition in relation to the combustion air can further reduce thermal NOx formation and quantity and enhance steam output.

In a stoker type boiler, it is preferable to mix TBLRC with the primary coal fuel prior to the stoker fingers using a gravity feed conveying means. Supplemental firing of TBLRC such as SynCoal has the effect of improving the quality of combustion by altering the average coal quality characteristics. Additionally, because of the rapid ignition and highly radiant flame characteristics heat transfer to the boiler walls is improved in the areas to more consistently match the initial design parameters.

EMPIRICAL RESULTS

The subject invention was installed on the Colstrip Unit 2 power plant in 1999. This unit has a 330 MW pulverized coal, tangentially fired boiler. This application provided an opportunity to demonstrate the impacts of the subject invention by comparing directly to the identical sister power plant, Colstrip Unit 1.

The first 10 months of operations indicate significant gains in boiler efficiency, total power generation, and operating hours. Also a reduction in auxiliary power demand was observed.

Unit 2 started demonstrating SynCoal as a supplemental fuel in February 1999. The baseline testing indicated that Unit 2 was typically producing 2.9 less MW net than Unit 1 when the testing started. In late May and June, Unit 1 was overhauled increasing its performance from an average 281 MWn to 288 MWn for the rest of the year. The baseline testing for the second half of the year indicates that Unit 2 would have produced 5.4 less MW net than Unit 1 if not for the addition of SynCoal. Actual performance shows that Unit 2 outperformed Unit 1 throughout the year. Unit 2 averaged 285.7 MWn versus 281.4 for Unit 1 through June and 288.8 versus 288.4 during July through December after the overhaul. If only the days SynCoal was used are included in this comparison the differences increase to 285.7 versus 278.4 through June and 292.7 versus 287.3 for the second half of the year.

When added to the expected short fall of Unit 2 production versus Unit 1 from the baseline testing, an average of 3.7% (10.2 MWn—first half and 10.8 MWn—second half respectively) additional net MW were generated from Unit 2 on days that SynCoal was used as a supplemental fuel. It is interesting to note that the increase in net generation increased in the second half even though the percentage of heat input represented by SynCoal decreased from 16.6% to 15.0%.

Over the entire period, the heat rate improved by 85 btu/kwh when firing SynCoal, with slightly more improvement in the second half, increasing from about 82 to about 87.6 btu/kwh even though the percentage of SynCoal declined slightly.

The impact on auxiliary power was very noticeable averaging about 1.0 MW decrease during the first half of the year and averaging about 1.9 MW decrease on a straight unit to unit comparison.

Based upon a review of Montana Department of Environmental Quality continuous emission monitoring (CEM) data for 1999, the nitrogen oxides (NOx) emissions were reduced by approximately 826 tons or 19 percent (Unit 2 had an emission rate of 0.327 compared to Unit 1's 0.394#/mmBtu emission rate). The actual sulfur dioxide (SOx) emissions were reduced by approximately 430 tons or 8 percent (Unit 2 had an emission rate of 0.403#/mmBtu compared to Unit 1's 0.452#/mmBtu emission rate) which is approximately the same reduction represented by the reduced sulfur in the combined fuel even though both Units 1 and 2 are scrubbed by an efficient scrubber. The reported data was used to determine the emission rates in lbs per mmbtu for each unit. The difference in emission rates were multiplied by the total thermal input for the year to determine the effective reduction at Unit 2. This is even more significant when it is recognized that the operations of Unit 2 were not attempting to reduce emissions with the use of the SynCoal. Additionally in 1998 without SynCoal, Unit 2's emission rates for SOx was 0.059 higher than Unit 1 (0.452 to 0.393#/mmBtu respectively) and NOx was 0.022 higher than Unit 1 (0.408 to 0.386 #/mmBtu respectively).

Tests conducted in 1999 at colstrip Unit 2 have shown additional benefits from this invention. For example, 191,000 fewer tons of raw coal handled, approximately 3,300 fewer tons of ash passing through the system and approximately 430 fewer tons of sulfur to be scrubbed, relative to the same amount of power produced using just raw coal.

A special method of this invention comprises providing thermally beneficiated low rank coal intermittently to achieve higher unit power output during relatively short peak demand periods of about four hours or less thereby causing less boiler slag and greater boiler efficiency. Note also that the beneficiated low-rank coal can be supplied relatively short peak demand periods of about four hours or less thereby achieving higher unit power output.

Obviously, many modifications may be made without departing from the basic spirit of the present invention.

Accordingly, it will be appreciated by those skilled in the art that within the scope of the appended claims, the invention may be practiced other than has been specifically described herein.

What is claimed is:

1. A method of improving the combustion properties of coal comprising adding an effective quantity of thermally beneficiated low rank coal to thereby obtain an increased combustion zone temperature, decreased ignition time, and a steadier flame and wherein the amount of added thermally beneficiated low rank is about 2 to 20%.

2. The method of claim 1 wherein the amount of added thermally beneficiated low rank coal is approximately 5 to 10%.

3. The method of claim 2 wherein the amount of added thermally beneficiated low rank coal is about 8%.

4. A method for improving the combustion properties of coal comprising feeding regular quantities of coal to the combustion chamber and then intermittently supplying supplemental quantities of thermally beneficiated low rank coal to the combustion chamber and thereby reducing boiler slag and increasing boiler efficiency.

5. The method of claim 4 comprises providing thermally beneficiated low rank coal intermittently to achieve higher unit power output during relatively short peak demand periods of about four hours or less thereby causing less boiler slag and greater boiler efficiency.

6. In a method of operating a coal-fired furnace, wherein the coal and ash melt and form a slag which coats the interior of the furnace, builds up and forms clinkers, and reduces the operating thermal efficiency of the furnace, and wherein relatively-expensive fuel oil or natural gas may be injected into the furnace as a "kicker" or "hot shot" to control the ash, reduce the slag, and improve thermal efficiency, the improvement which comprises the step of inputting a beneficiated low-rank coal which has been processed to remove impurities and moisture content, thereby obviating the use of relatively-expensive fuel oil or natural gas, and thereby controlling the ash and the formation of slag, improving safety conditions, and improving the thermal efficiency while realizing cost savings and wherein the beneficiated low-rank coal is mixed with the coal being supplied to the furnace.

7. The method of claim 6 wherein the beneficiated low-rank coal is supplied during relatively short peak demand periods of about four hours or less thereby achieving higher unit power output.

8. The method of claim 4 wherein the supplemental quantities of thermally beneficiated low rank coal is supplied once unacceptable slag buildup is observed.

9. A combustible coal mixture comprising an effective amount of thermally beneficiated low rank coal added to ordinary coal wherein an increased combustion zone temperature, decreased ignition time, and a steadier flame are obtained, and emission of noxious gas is reduced and wherein the amount of thermally beneficiated low rank coal added is about 2 to 20%.

10. The combustible coal mixture claim 9 wherein the amount of thermally beneficiated low rank coal is approximately 5 to 10%.

11. The combustible mixture of claim 10 wherein the amount of thermally beneficiated low rank coal is about 8%.

* * * * *